US005207495A

United States Patent [19]

Ahlstone

[11] Patent Number: 5,207,495

[45] Date of Patent: May 4, 1993

[54] GRAPHIC ARTS LIGHT BOX

[75] Inventor: Arthur G. Ahlstone, Ventura, Calif.

[73] Assignee: Vemco Corporation, San Dimas, Calif.

[21] Appl. No.: 727,002

[22] Filed: Jul. 8, 1991

[51] Int. Cl.[5] ..... F21V 13/00

[52] U.S. Cl. ..... 362/33; 362/97; 108/23

[58] Field of Search ..... 362/97, 33, 154, 98; 108/23

[56] References Cited

U.S. PATENT DOCUMENTS

| | | |
|---|---|---|
| 520,991 | 6/1894 | Howard . |
| 920,593 | 5/1909 | Leslie . |
| 1,346,705 | 7/1920 | Gibson . |
| 1,429,802 | 9/1922 | Thompson . |
| 1,525,309 | 2/1925 | Lund . |
| 1,546,089 | 7/1925 | Leachman et al. . |
| 1,607,922 | 11/1926 | Schweitzer . |
| 1,652,636 | 12/1927 | Paul . |
| 1,725,230 | 8/1929 | Ulrich . |
| 1,804,651 | 5/1931 | Shipman . |
| 1,820,912 | 9/1931 | Kelly . |
| 1,846,533 | 2/1932 | Thompson . |
| 1,882,647 | 10/1932 | Kanolt . |
| 1,930,359 | 10/1933 | Hilgenberg . |
| 2,043,193 | 6/1936 | Dunn et al. . |
| 2,062,887 | 12/1936 | Karst . |
| 2,107,641 | 2/1938 | Malcomson . |
| 2,163,763 | 6/1939 | Ray . |
| 2,197,965 | 4/1940 | Booth . |
| 2,323,059 | 6/1943 | Land . |
| 2,522,812 | 9/1950 | Bonnet . |
| 2,523,290 | 9/1950 | Gardner . |
| 2,623,313 | 12/1952 | Fuchs . |
| 2,634,530 | 4/1953 | Herschede et al. . |
| 2,654,827 | 10/1953 | Pierce . |
| 2,702,440 | 2/1955 | Marchand . |
| 2,814,895 | 12/1957 | Flam . |
| 2,824,399 | 2/1958 | Neugass . |
| 2,861,173 | 11/1958 | Nordquist . |
| 2,902,787 | 9/1959 | Cook . |
| 3,024,701 | 3/1962 | Marks et al. . |
| 3,124,639 | 3/1964 | Kahn . |
| 3,184,594 | 5/1965 | Siegel . |
| 3,271,568 | 9/1966 | Lundberg . |
| 3,289,342 | 12/1966 | Gibson, Jr. . |
| 3,294,964 | 12/1966 | Schwartz . |
| 3,324,290 | 6/1967 | Lasker . |
| 3,350,982 | 11/1967 | Marks . |
| 3,492,486 | 1/1970 | Bischoff et al. . |
| 3,602,590 | 8/1971 | Lukens . |
| 3,629,965 | 12/1971 | Heindle, Jr. . |
| 3,688,424 | 9/1972 | Von Zanten . |
| 3,755,664 | 8/1973 | Reiback . |
| 3,771,245 | 11/1973 | Mabrey et al. . |
| 3,829,998 | 8/1974 | Flax . |
| 3,997,991 | 12/1976 | Hayman-Chaffey et al. . |
| 4,021,949 | 5/1977 | Niehaus et al. . |
| 4,034,494 | 7/1977 | Lane . |
| 4,071,748 | 1/1978 | Dey . |
| 4,118,111 | 10/1978 | Laesser . |
| 4,123,141 | 10/1978 | Schuler . |
| 4,132,464 | 1/1979 | Maeno . |
| 4,159,871 | 7/1979 | Arnone ..... 362/33 |

(List continued on next page.)

FOREIGN PATENT DOCUMENTS

| | | |
|---|---|---|
| 413323 | of 1910 | France . |
| 2084461 | 4/1982 | United Kingdom . |

*Primary Examiner*—Carroll B. Dority
*Attorney, Agent, or Firm*—William W. Haefliger

[57] ABSTRACT

A graphic arts work center comprising a box having a bottom wall, upright side walls, and an associated frame; a light diffuser plate carried by the frame to overlie the bottom wall and define therewith an illumination space; illumination structure in the space to illuminate the underside of the diffuser plate; and a cover retained by the box to overlie the plate and to be upwardly removable to expose the plate for transmitting light to work placed over the plate; the box having auxiliary receptacle structure for storage of equipment usable in conjunction with use of the work placed over the plate.

22 Claims, 7 Drawing Sheets

U.S. PATENT DOCUMENTS 4,185,407 1/1980 Lamb .
4,206,501 6/1980 Brooks .
4,244,130 1/1981 Frois .
4,261,125 4/1981 Rappaport .
4,267,489 5/1981 Morohashi .
4,318,163 3/1982 Bryan .
4,386,476 6/1983 Schulman .
4,414,767 11/1983 Staton .
4,418,378 11/1983 Johnson .
4,469,726 9/1984 Niinivuo .
4,475,298 10/1984 Munoz .
4,542,449 9/1985 Whitehead .
4,564,886 1/1986 Morcheles ..... 362/97
4,587,754 5/1986 Ossner .
4,602,448 7/1986 Grove ..... 362/97
4,637,150 1/1987 Geluk .
4,649,462 3/1987 Dobrowolski et al. .
4,654,762 3/1987 Laverick ..... 362/97
4,922,384 5/1990 Torrence .

10
2
10
120
123
14
21
18
21a
9
14a
8
121
24
23
22
19
136
25
135
51c
118
20
51d
9
51b
15
16
18
110a
51a
17
10
110
18
13
51
8
17

3
110
10
15
135
136
14
16
17
12
21a
11
18
21
17
3

10
110
33
21
11
11
~16~
~20~
13
17
11
12
18
6
17
6

5
11
14
33
16
13
α
17
5
~20~
β
17
12
36
18
21

16
135
136
14
15
~41~
~40~
17
14a
17
11
20
19

GRAPHIC ARTS LIGHT BOX

BACKGROUND OF THE INVENTION

The invention relates generally to light boxes, and more particularly, to an improved light box construction providing what may be referred to as a portable graphic arts work center.

In the past, light boxes contained a lamp and a glass or plastic sheet providing an illuminated work viewing area. There is need for an improved light box construction providing additional functions, as are described herein.

SUMMARY OF THE INVENTION

It is a major object of the invention to provide an improved light box construction, as referred to, and which defines a graphic arts center. Basically, the apparatus comprises:

a) a box having a bottom wall, upright side walls, and an associated frame, b) a translucent light diffuser plate carried by the frame to overlie the bottom wall and define therewith an illumination space, c) illumination means in that space to illuminate the underside of the diffuser plate, d) and a cover carried by the box to overlie the diffuser plate and to be upwardly removable to expose the plate for transmitting light to work placed over the plate, e) the box having auxiliary receptacle means for storage of equipment usable in conjunction with use of the work placed over the plate.

It is another object to provide a structure, as referred to, having a rectangular frame defining first grooving facing laterally for receiving rectangular peripheral portions of the plate, the frame also defining second grooving facing upwardly for compressively and removably receiving peripheral edge portions of the cover.

An additional object is to provide illumination means in the form of elongated fluorescent bulb means extending in the illumination space, and a light reflector extending in that space in proximity to the bottom wall to face the diffuser plate for reflecting light from the bulb means toward that plate. The improved reflector typically has reflecting surfaces facing laterally toward opposite sides of the bulb means as well as facing upwardly toward the underside of the plate, to provide uniform or near uniform illumination of the plate.

Yet another object is the provision of a U-shaped handle having parallel arms extending adjacent opposite ends of the box, and a cross-piece extending at a side of the box, the handle forming with the box an open grip space. The arms may have pivotal attachment to opposite ends of the box, with adjustable means to position the handle at a pivot angle relative to the box to support the box at a selected tilt angle relative to a support surface.

Additionally, the light box means may include at least one of the following:

$x_1$) a tool receptacle at one side of the box, $x_2$) an electrical power cord receptacle at one side of the box.

All of such receptacles may be located at one side of the box, and a handle provided to be movably attached to the box and protectively extending over at least one of the $x_1$) and $x_2$) receptacles. The handle may also form a hand grip zone between the receptacles.

Finally, the frame may be removably attached to support structure on the box to allow frame and plate upward removal, thereby providing access to the illumination means in the illuminating space for adjustment or replacement of the illumination means.

These and other objects and advantages of the invention, as well as the details of an illustrative embodiment, will be more fully understood from the following specification and drawings, in which:

DRAWING DESCRIPTION

DETAILED DESCRIPTION

Figure 1:
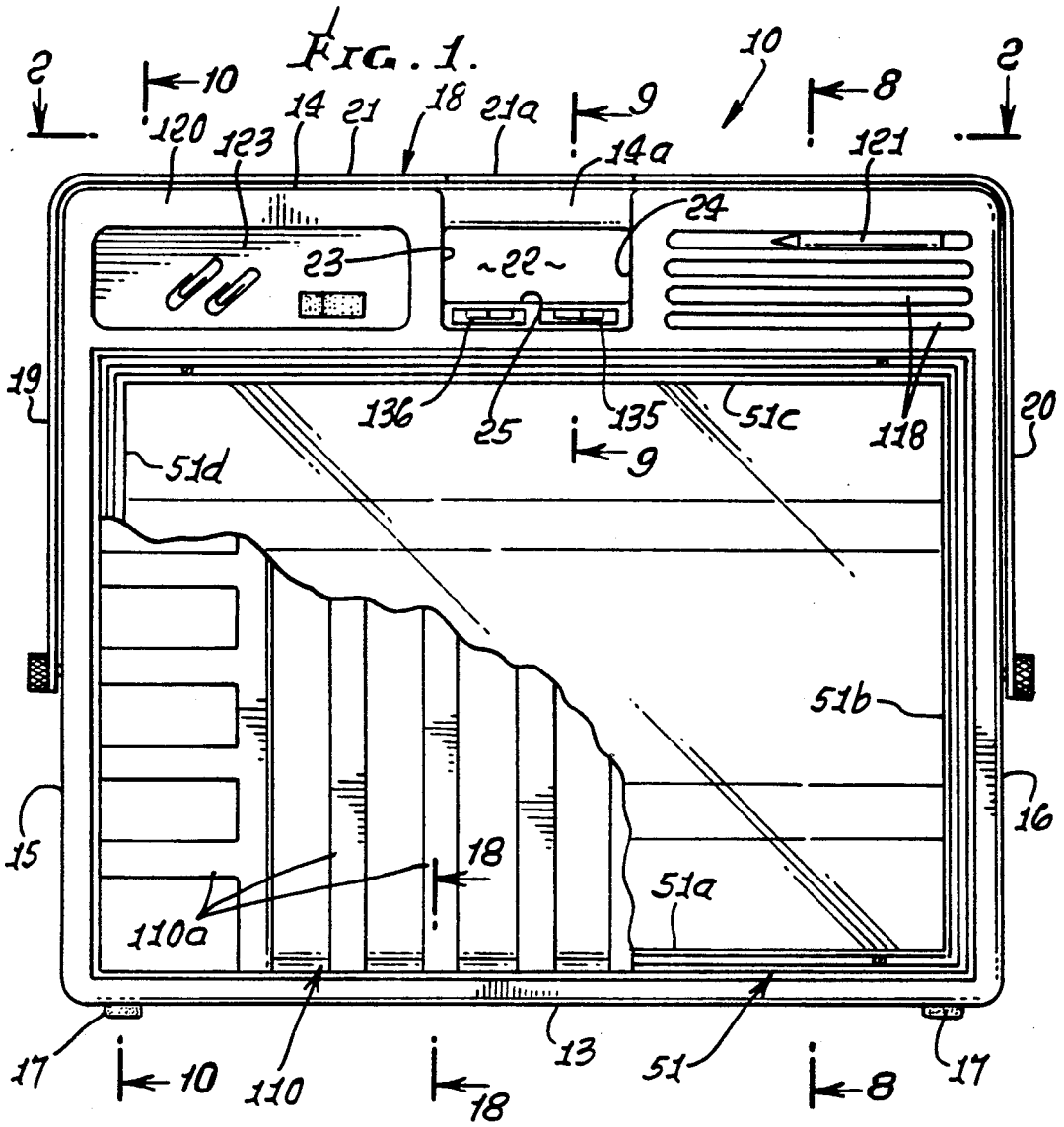
FIG. 1 is a top plan view of a graphic arts work center apparatus incorporating the invention.
Figure 2:
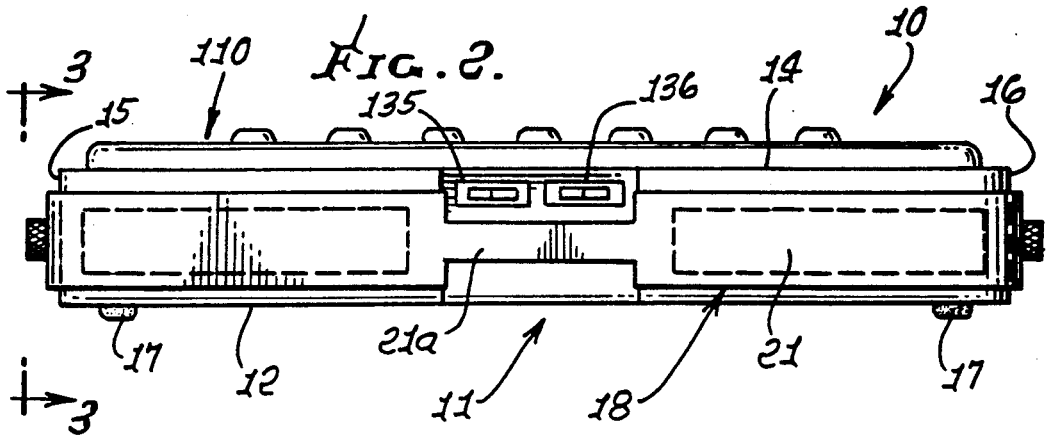
FIG. 2 is an edge view taken on lines 2—2 of FIG. 1.
Figure 11:
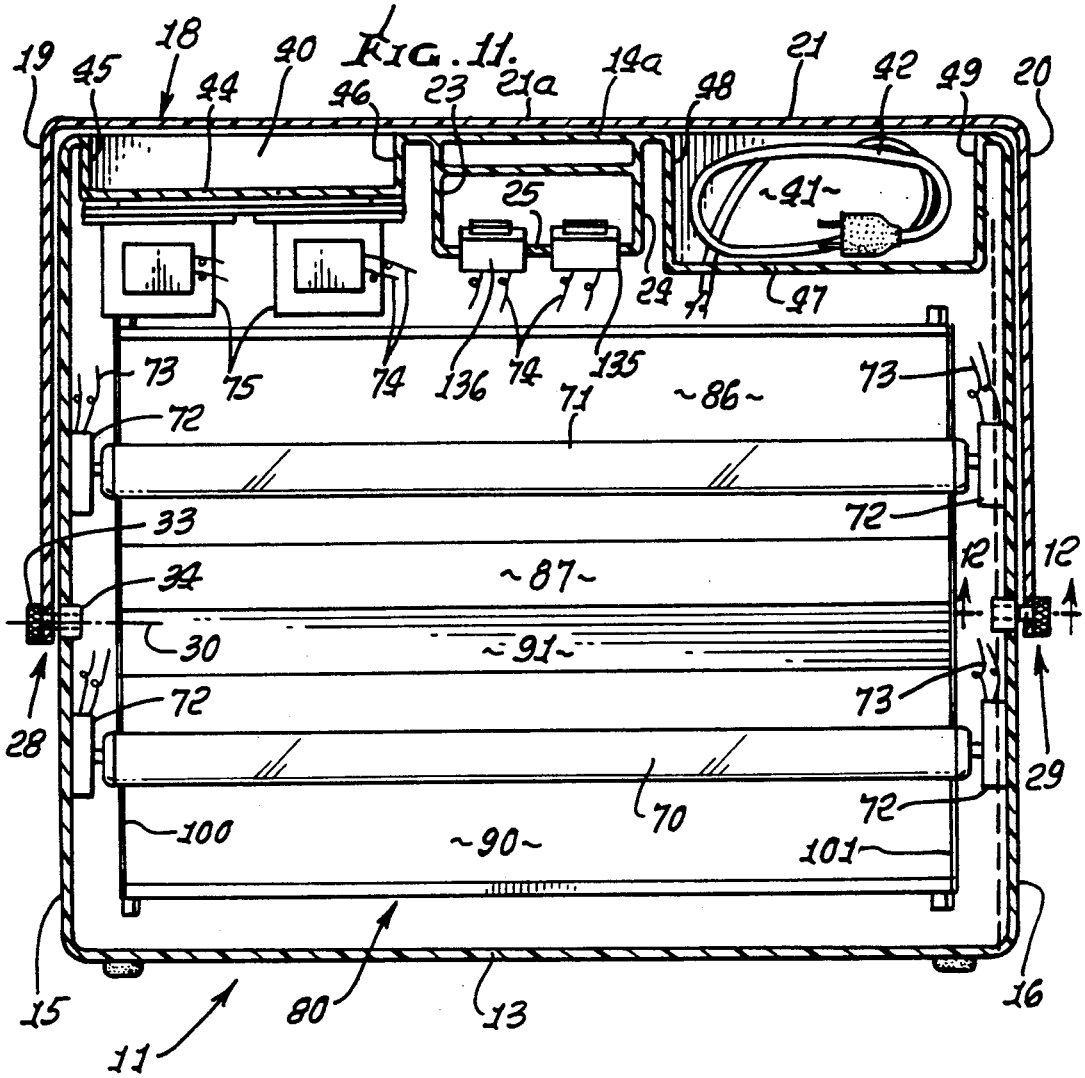
FIG. 11 is a horizontal section taken on lines 11—11 of FIG. 3.

In the drawings, the graphic arts work center equipment 10, FIG. 1, includes a shallow box 11 having a bottom wall 12, upright side walls 13 and 14, and upright end walls 15 and 16. Support bottoms 17 are carried by the bottom wall 12 and by the side wall 13, whereby the box can be supported on its side, in the manner of a briefcase, as during transport, or on its bottom, as during use. A U-shaped handle 18 has parallel arms 19 and 20 extending adjacent opposite end walls, and a cross-piece 21 extending at a side of the box, as seen in FIGS. 1 and 11. The cross-piece is narrowed in width at **21*a* and forms, with the box, a through opening 22 defining a grip zone midway between box end walls 15 and 16. Thus, the narrowed mid-portion 21*a* of the cross-piece and mid-portion 14*a* of wall 14 may be hand gripped allowing lifting and transport of the box. Note box walls 23–25 adjacent opening 22**.

Figure 12:
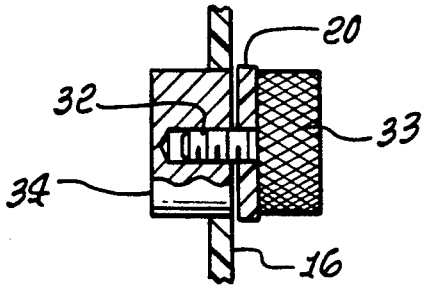
FIG. 12 is an enlarged fragmentary section taken on lines 12—12 of FIG. 11.
Figure 14:
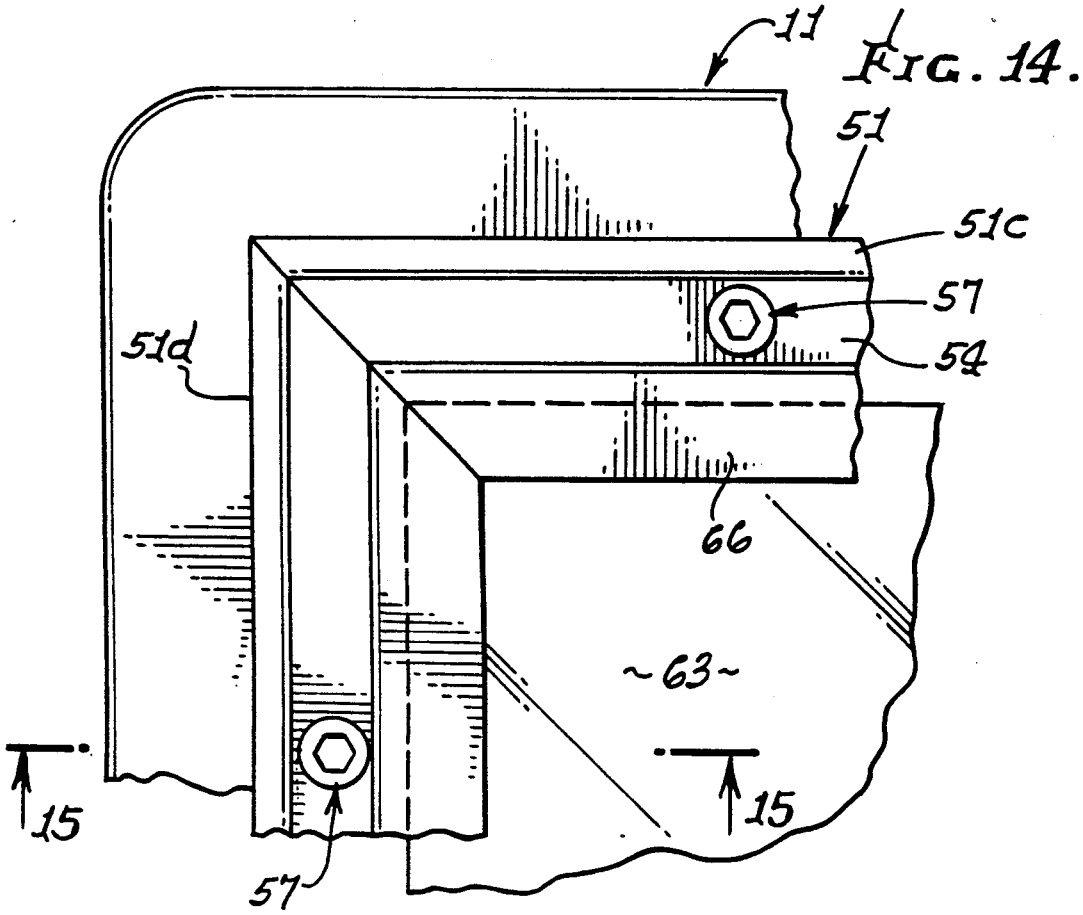
FIG. 14 is an enlarged plan view of a corner portion of the frame and box structure.

As seen in FIG. 11, the two arms 19 and 20 have pivotal attachment at 28 and 29 to the opposite end walls 15 and 16 allowing adjustable pivoting of the handle about axis 30 parallel to side wall 13. FIG. 12 shows a pivot in the form of a threaded stem 32 attached to rotary adjustment knob 33. When the knob is tightened, the arm 20 is clamped against the support 34 into which stem 32 is threaded. Support 34 is carried by wall 16. Similar elements 32–34 are associated with arm 19 and end wall 15.

Figure 4:
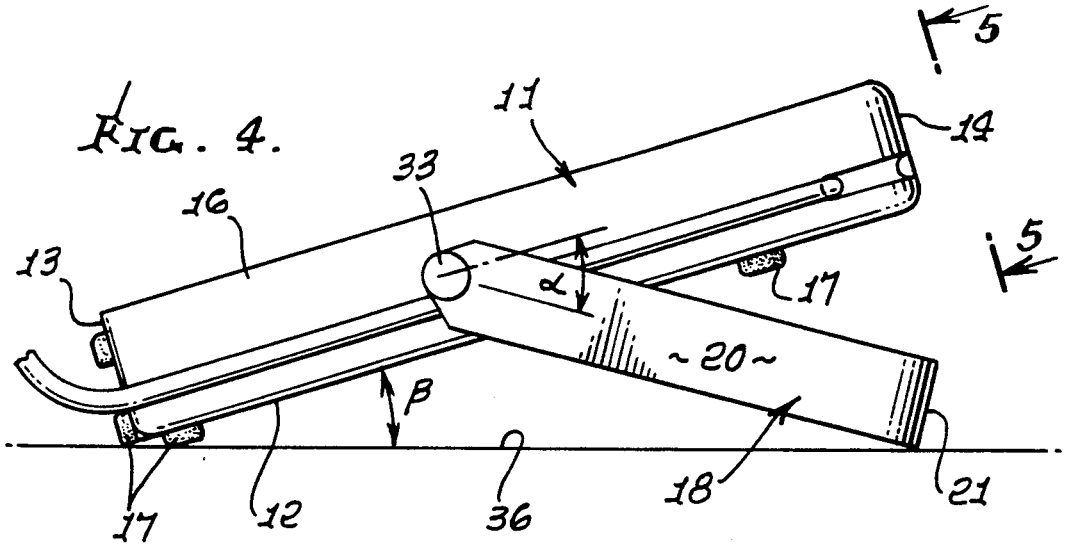
FIG. 4 is a view like FIG. 3 showing the handle swiveled to provide a box support, the box tilted at a selected angle for use.

FIG. 4 shows the handle 1B rotated to a selected pivot angle $\alpha$ relative to the box to support the box at a selected tilt angle $\beta$ relative to a support surface 36. Note the box support buttons 17 supporting the box on surface 36, and the handle edge 18*a* engaging that surface. Knobs 33 are tightened with the arm 20 in the position shown.

Figure 3:
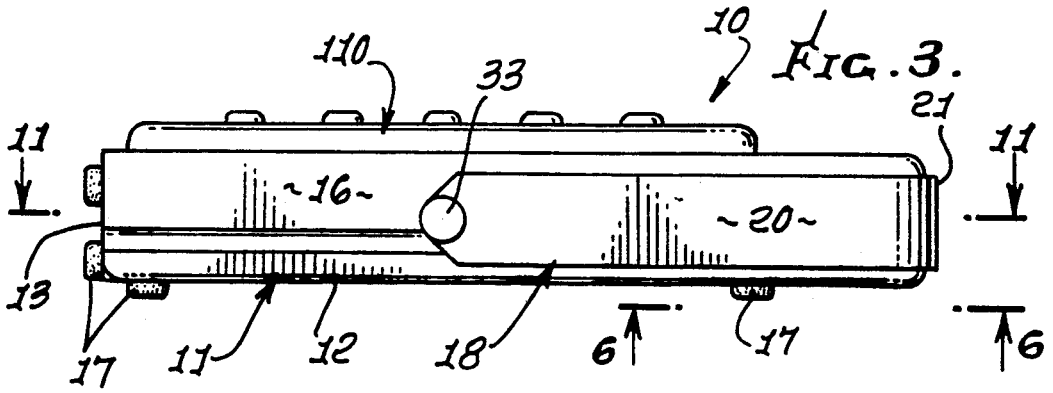
FIG. 3 is an edge view taken on lines 3—3 of FIG. 2.
Figure 8:
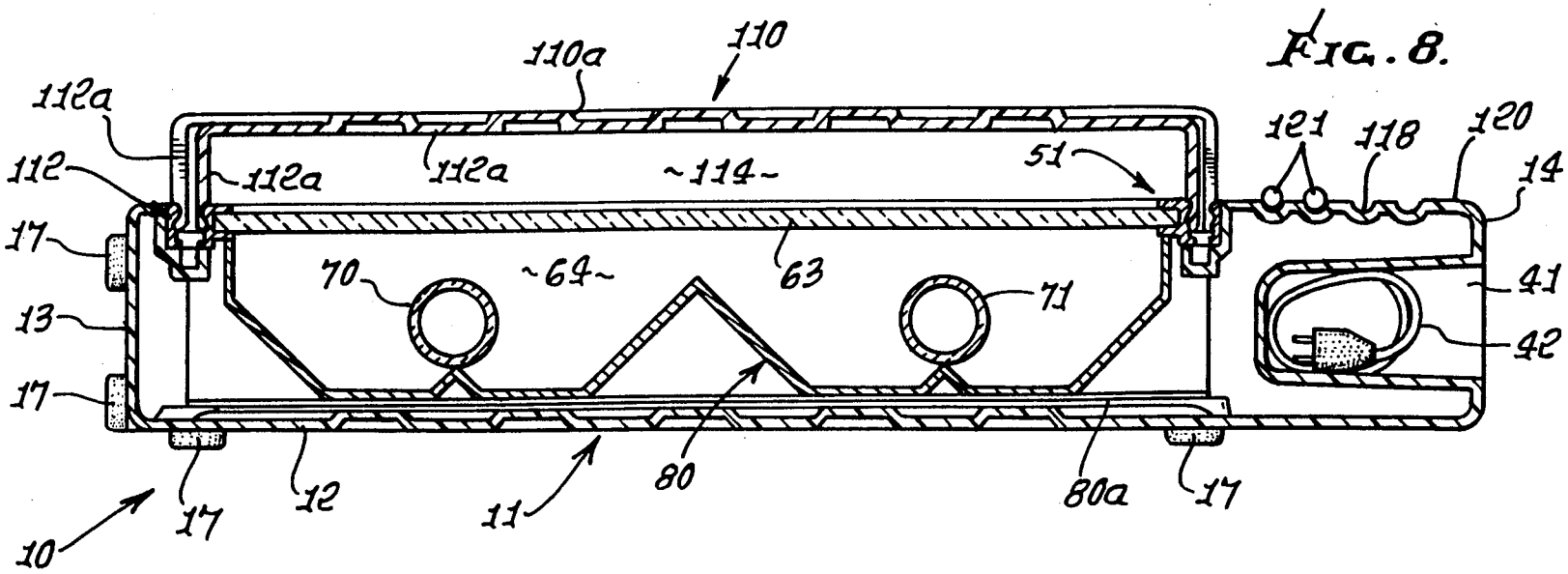
FIG. 8 is an enlarged section taken on lines 8—8 of FIG. 1.
Figure 9:
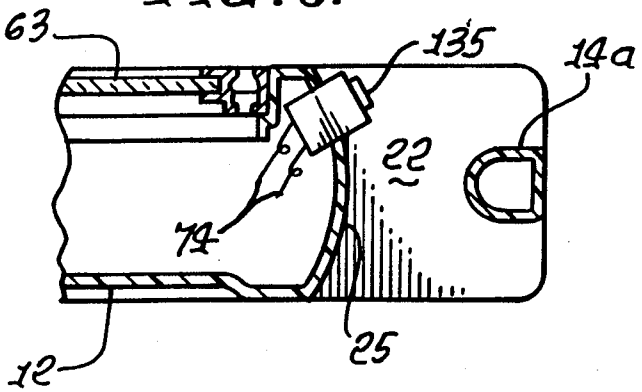
FIG. 9 is an enlarged fragmentary section taken on lines 9—9 of FIG. 1.
Figure 13:
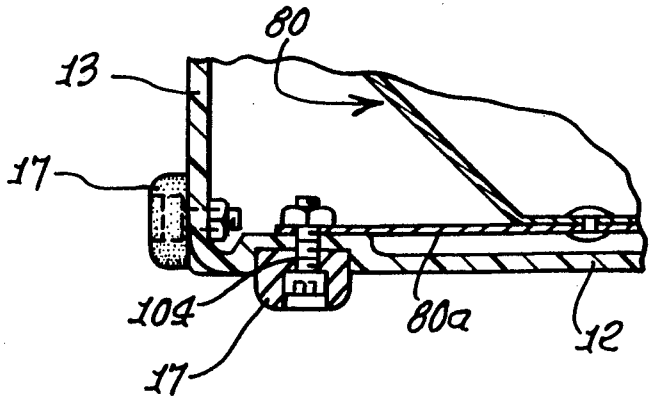
FIG. 13 is an enlarged view of corner structure indicated by lines 13—13 of FIG. 10.
Figure 10:
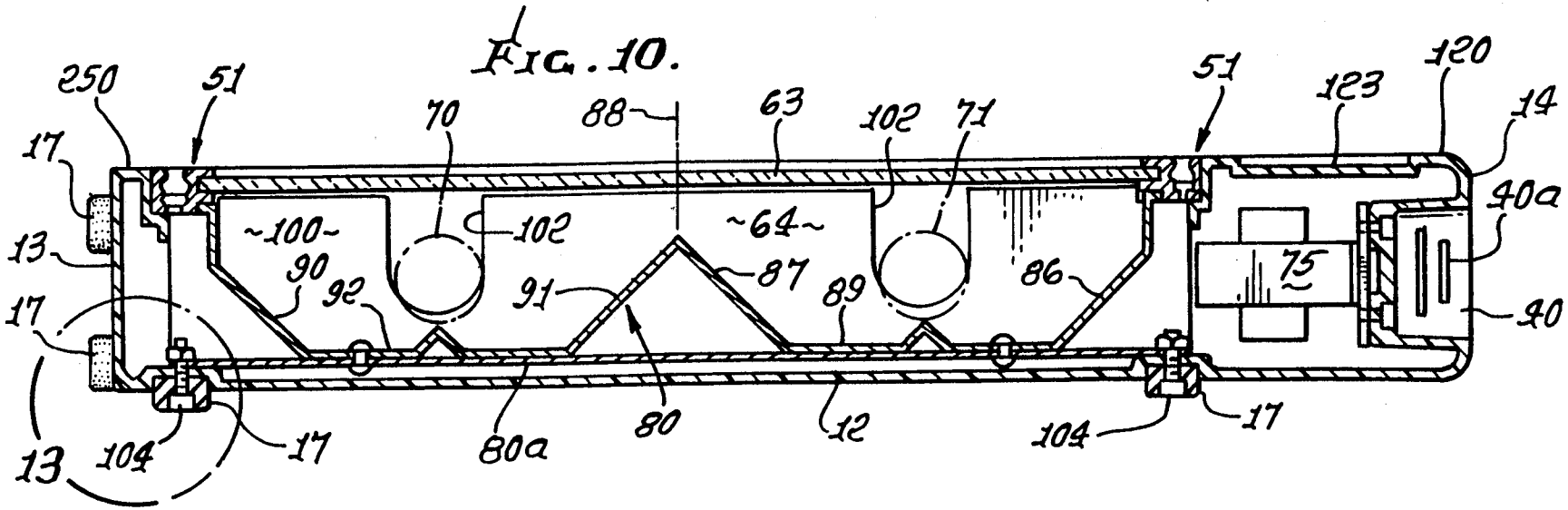
FIG. 10 is an enlarged section taken on lines 10—10 of FIG. 1.

When the arm 20 is in FIG. 3 position, the arm cross-piece 21 extends protectively over recessed receptacles 40 and 41 at the side of the box associated with wall 14. As seen in FIGS. 10 and 11, receptacle 40 may carry graphic arts tools or other implements 40*a*; and as seen in FIGS. 8 and 11, receptacle 41 may carry or receive an electrical power cord 42 in coiled condition, to be extended to plug into an electrical socket when the light box is in use. Receptacles 40 and 41 open outwardly toward the protective covering cross-piece 21 in FIG. 11. Note receptacle walls 44–46 and 47–49.

Figure 15:
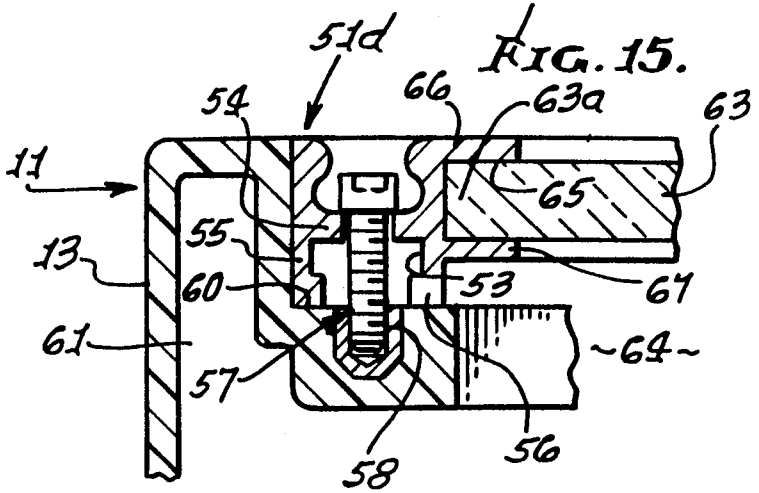
FIG. 15 is a section taken on lines 15—15 of FIG. 14.
Figure 16:
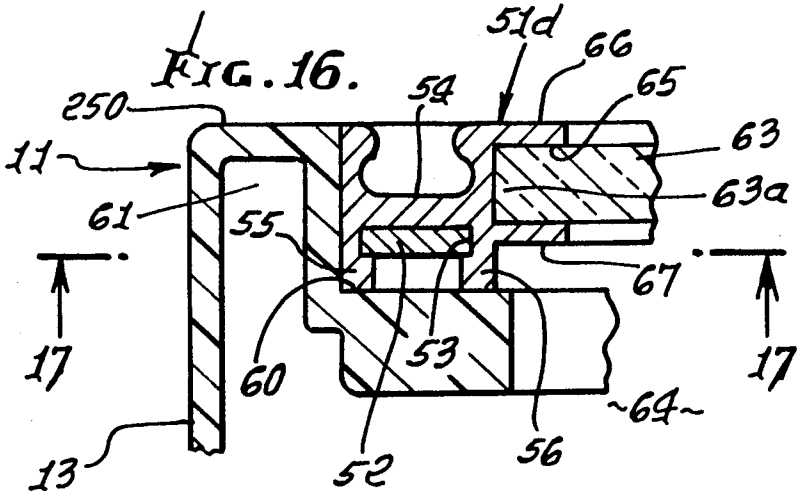
FIG. 16 is an enlarged fragmentary section showing frame and box construction, in elevation.
Figure 17:
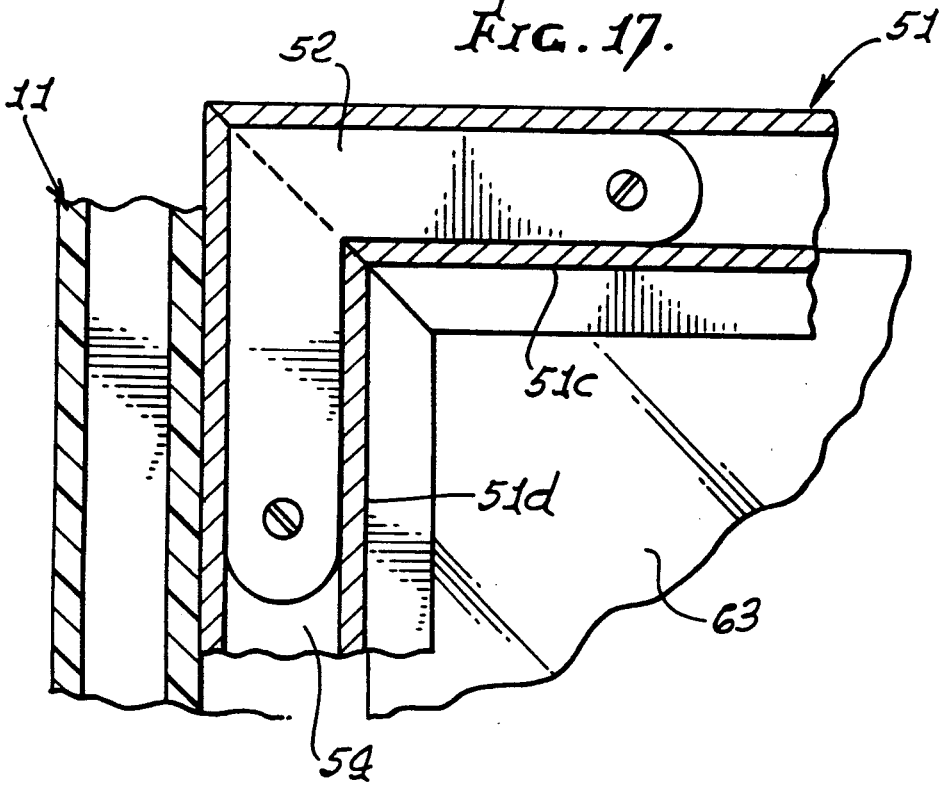
FIG. 17 is a section taken on lines 17—17 of FIG. 16.

The box 11 has an associated frame which is typically removably carried by the box. See for example frame 51 having four elongated stretches 51*a*, 51*b*, 51*c*, and 51*d*. The latter may be connected at intersection corners, as by L-shaped brackets 52 seen in FIGS. 16 and 17. The brackets fit into recesses 53 formed in the frame stretches, and beneath frame struts 54. The frame in section is generally H-shaped, as seen in FIGS. 15 and 16, with lower legs 55 and 56 seating on ledge 60 integral with the box wall 13, and offset downwardly from the box top wall 250, and inwardly from box walls 13–16. Ledge 60 is re-entrant into box peripheral interior space 61. Fasteners 57 extend through the struts 54 on the frame stretches and threadably attach to the ledges, as at 58. See FIG. 15. Thus, the rectangular frame is attached to the box to be removable, along with a diffuser plate 63 carried by the frame to provide access to the box interior 64.

The diffuser plate 63 consists of glass or plastic or other material and is translucent. Its peripheral edges 63*a* are received in laterally facing grooves 65 formed by upper and lower flanges 66 and 67 integral with the frame stretches. See FIG. 16. Separability of the frame stretches from plate 63, allows plate replacement, after the frame is itself removed from the box.

Plate 63 overlies the box bottom wall 12, and defines therewith the illumination space 64 under the plate. Illumination means is provided in that space to illuminate the underside of the diffuser plate 63. That illumination means typically includes elongated fluorescent bulb means, such as bulbs 70 and 71 extending in parallel relation in space 64. See FIGS. 8, 10 and 11. The opposite terminal ends of the bulbs are received in electrical socket bodies 72, from which wiring extends at 73 to ballast means 75 or other circuitry 74, the ballast 75 supplying the required voltage to the bulbs for operation thereof.

The illumination means may also be considered to include a reflector plate 80 extending in the space between wall 12 and plate 63 to face the diffuser plate 63 for reflecting light from the bulbs 70 and 71 toward plate 63. That plate sub-tends the major areal dimensions of bottom wall 12 (see FIG. 11), as well as of plate 63, and substantially completely underlies the two bulbs. FIG. 10 shows the reflector plate as having angled surfaces 86 and 87 facing laterally oppositely toward opposite sides of the bulb 71, as well as facing upwardly toward the underside extent of plate 63 to right of an upright plane 88. Surfaces 86 and 87 reflect laterally emitted bulb light toward plate 63. See also reflector surfaces 89 extending parallel to plate 63 and beneath the level of bulb 71 to reflect bulb downwardly emitted light toward the plate 63 to the right of plane 88.

Likewise, the reflector has angled surfaces 90 and 91 facing laterally oppositely toward apparatus sides of bulb 70, as well as facing upwardly toward the underside extent of plate 63 to the left of plane 88. Surfaces 90 and 91 reflect laterally emitted bulb light toward plate 63. See also the reflector surfaces 92 extending parallel to plate 63 and beneath the level of bulb 70, to reflect bulb downwardly emitted light toward the plate 63. Opposite ends of the reflector plate 80 are turned upwardly at 100 and 101, and pass the bulbs at 102. The plate 80 may be removably attached to bottom wall 12, as via an auxiliary subplate 80*a* attached by fasteners 104 to the wall 12. Those fasteners also retain the support buttons 17 to that wall. See FIG. 10.

Figure 18:
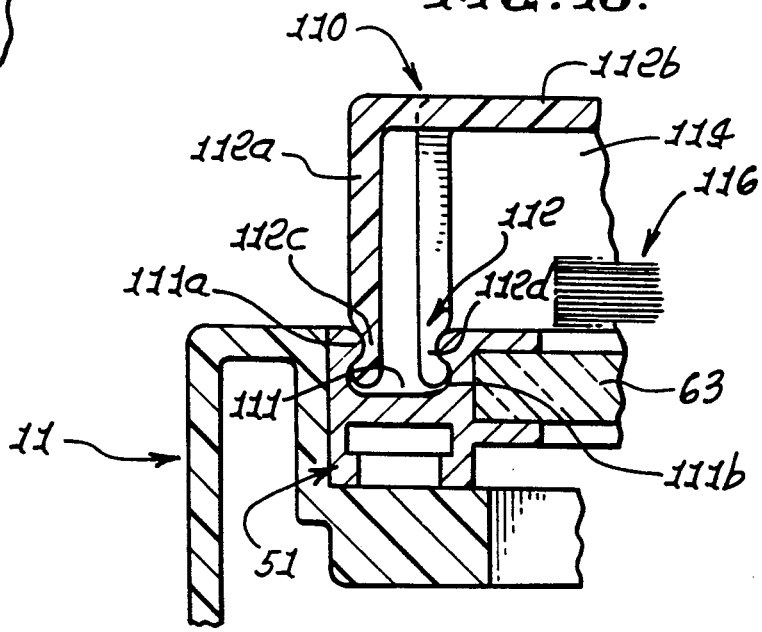
FIG. 18 is a section taken on lines 18—18 of FIG. 1, and a view like FIG. 16, but also showing the cover releasable connection to the frame.

Also provided is a protective cover 110 carried by the box 10 to overlie the diffuser plate 63, to be upwardly removable to expose that plate for viewing while light back-illuminates the plate and work, such as drafting paper applied over plate 63. See for example cover 110 in FIGS. 8 and 18 removably supported by frame 51. The latter is shown to have upwardly opening grooving 111 to receive an compressively removably grip edge portions 112 of the cover. Those edge portions typically project downwardly, as on a skirt 112*a* formed by the cover and depending from a cover wall 112*b* extending parallel to plate 63. The edge portions 112 may be bifurcated to form cantilevered sections 112*c* and 112*d*, (see FIG. 18) with convex cam surfaces allowing the sections to resiliently deflect toward one another as the sections 112*c* and 112*d* are pushed into the neck 111*a* of groove 111, the sections 112*c* and 112*d* then springing apart to seat in groove enlargement 111*b*. The cover 110 is thereby firmly gripped by the frame 51, but yet is forcibly upwardly removable, as required. Space 114 beneath raised wall 112*b* and above plate 63 is adapted to receive and store work, such as sheets of paper, booklets, etc., indicated at 116 in FIG. 18. After removal of the cover 110, the frame 51 and diffuser 63 may be detached as a unit from the box, to gain access to underspace (illumination) 64, as for changing the bulbs 70 and 71, or to gain access to ballast 75. Cover 110 may be corrugated at 110*a* (see FIGS. 1 and 8) for increased stiffness. The box and its cover may consist of a plastic material, such as high density polyethylene. The frame and reflector may consist of aluminum.

Figure 5:
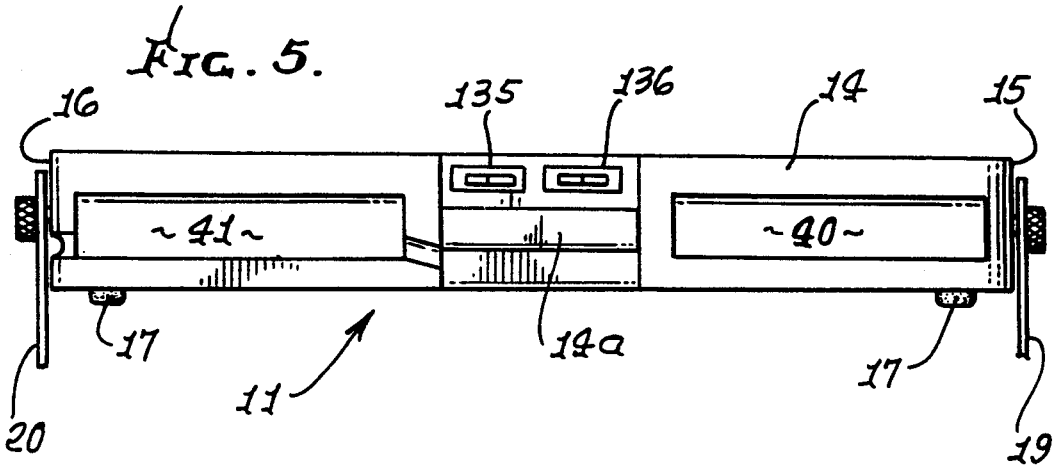
FIG. 5 is an edge view taken on lines 5—5 of FIG. 4.

The graphic arts work center may also include grooves 118 in box top wall 120, for storage of pencils 121, as during use of the device. See FIG. 8. A well 123 may also be formed in wall 120, for storage of paper clips, erasers, etc., as shown in FIG. 1. FIG. 5 shows switches 135 and 136 to turn on the bulbs, individually.

Figure 6:
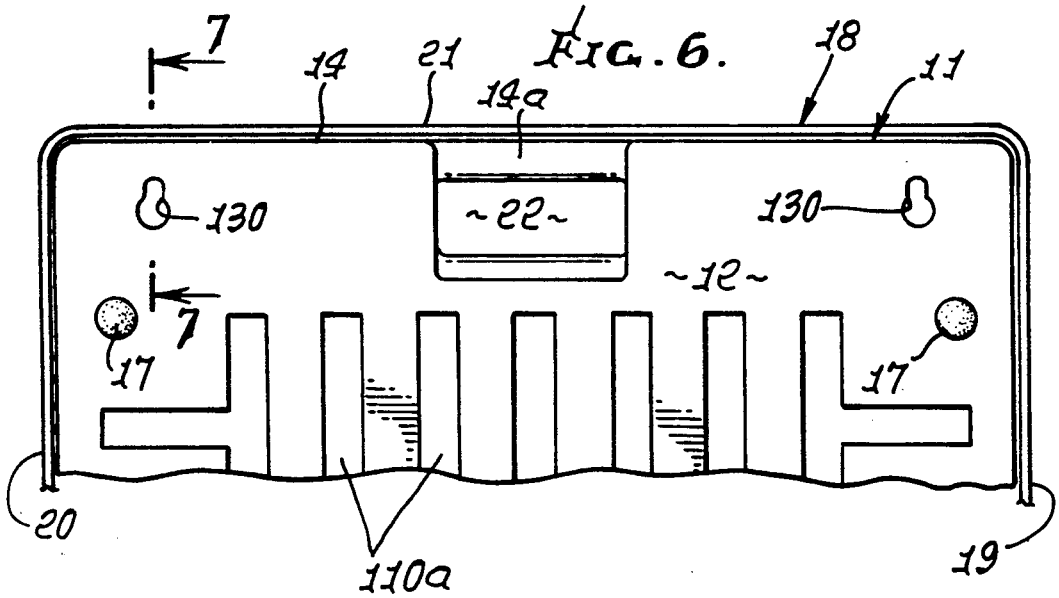
FIG. 6 is a fragmentary bottom view taken on lines 6—6 of FIG. 3.
Figure 7:
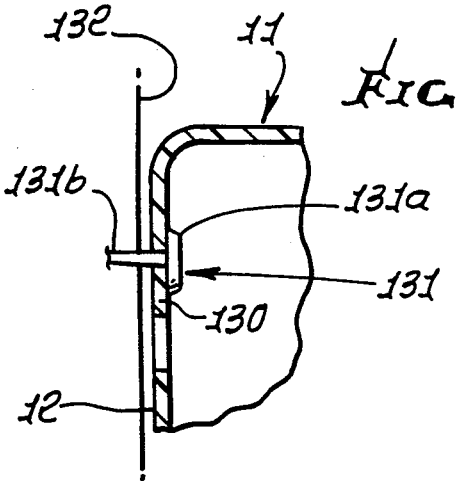
FIG. 7 is a fragmentary section taken on lines 7—7 of FIG. 6.

FIGS. 6 and 7 show provision of means for mounting the light box on a wall. See openings 130 in back (bottom) wall 12, to receive hangers, shown as pins 131 having heads 131*a*, and shanks 131*b* passing through the openings 130 and into the wall 132.

I claim:

1. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) and wherein said frame has associated grooving, g) the edge of the cover being held in said grooving by retaining means.

2. The combination of claim 1 wherein said frame is rectangular and said grooving receives peripheral portions of said plate.

3. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the fox to overlie said plate and to be upwardly removable to expose said plate for transmitting light to work placed over the plate, e) the box having auxiliary receptacle means for storage of equipment usable in conjunction with use of said work placed over the plate, f) and wherein said frame has grooving to compressively and removably receive edge portions of the cover.

4. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) and wherein said frame is rectangular and defines first grooving facing laterally for receiving rectangular peripheral portions of said plate, the frame also defining second grooving facing upwardly for compressively and removably receiving peripheral edge portions of the cover.

5. The combination of claim wherein said illumination means includes elongated fluorescent bulb means extending in said illumination space, and a light reflector extending in said space in proximity to said bottom wall to face the diffuser plate for reflecting light from said bulb means toward that plate.

6. The combination of claim 5 wherein said reflector has reflecting surfaces facing laterally toward opposite sides of said bulb means as well as facing upwardly toward the underside of said plate.

7. The combination of claim 6 wherein said bulb means includes two parallel elongated bulbs, and there are two pairs of said reflecting surfaces, the reflecting surfaces of one pair facing laterally toward opposite sides of one bulb, and the reflecting surfaces of the other pair facing laterally toward opposite sides of the other bulb.

8. The combination of claim 1 wherein said cover includes a wall spaced upwardly from the plate to define therewith a storage space.

9. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) and including a U-shaped handle having parallel arms extending adjacent opposite ends of the box, and a cross-piece extending at a side of the box, said handle forming with the box an open grip space.

10. The combination of claim 9 wherein said arms have pivotal attachment to said opposite ends of the box, and adjustable means to position the handle at a pivot angle relative to the box to support the box at a selected tilt angle relative to a support surface.

11. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) said frame being rectangular and defining grooving receiving peripheral portions of said plate, g) and wherein said side walls have frame-supporting structure, and including attachment means removably attaching the frame to said supporting structure to allow frame and plate upward removal, thereby providing access to the illumination means in said illuminating space for adjustment or replacement of said illumination means.

12. The combination of claim 1 wherein said receptacle means includes at least one of the following:

$x_1$) a tool receptacle at one side of the box, $x_2$) an electrical power cord receptacle at one side of the box.

13. The combination of claim 12 wherein said $x_1$) and $x_2$) receptacles are located at one side of the box.

14. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser late, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) said receptacle means including at least one of the following:

$x_1$) a tool receptacle at one side of the box, $x_2$) an electrical power cord receptacle at one side of the box, g) and including a handle movably attached to the box and protectively extending over at least one of said $x_1$) and $x_2$) receptacles.

15. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) said receptacle means including at least one of the following:

$x_1$) a tool receptacle at one side of the box, $x_2$) an electrical power cord receptacle at one side of the box, g) said $x_1$) and $x_2$) receptacles located at one side of the box, h) and including a handle pivotally attached to the box and protectively extending over both of said $x_1$) and $x_2$) receptacles.

16. The combination of claim 15 wherein the handle forms with the box a hand grip space between two of said receptacles.

17. The combination of claim 4 wherein the frame includes multiple stretches which are removably attached together to define a rectangle, the stretches separable from the periphery of the diffuser plate to allow plate replacement.

18. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) said frame being rectangular and defining first grooving facing laterally for receiving rectangular peripheral portions of said plate, the frame also defining second grooving facing upwardly for compressively and removably receiving peripheral edge portions of the cover, g) and wherein the cover includes a wall extending over the diffuser plate, and a skirt defining said peripheral edge portions of the cover, there being storage space between said cover wall and said diffuser plate, inwardly of said skirt.

19. A graphic arts work center comprising a) a box having a bottom wall, upright side walls, and an associated frame, b) a light diffuser plate carried by the frame to overlie the bottom wall and define therewith an illumination space, c) illumination means in said space to illuminate the underside of the diffuser plate, d) and a cover retained by the box to overlie said plate and to be upwardly removable to expose said plate for transmitting light to work placed over the plate, e) the box having auxiliary receptacle means for storage of equipment usable in conjunction with use of said work placed over the plate, f) said frame being rectangular and defining first grooving facing laterally for receiving rectangular peripheral portions of said plate, the frame also defining second grooving facing upwardly for compressively and removably receiving peripheral edge portions of the cover, g) and wherein the box defines a re-entrant ledge below the top levels of the box side walls, and located inwardly of said side walls, the frame supported by said ledge and removably attached thereto.

20. The combination of claim 1 including means associated with a box wall to hang the box from an upright wall.

21. The combination of claim 2 including a storage means associated with said assembly for storing one or more of the following: power cord, pencils, pen, knife, eraser, other tools, paper, transparencies, drawings, sketches, notes, small books, paper clips, etc., when the graphic arts work center is in use, or is not in use, or is being transported.

22. The combination of claim 1 including an inclination adjustment means carried by the assembly for varying the angle of the light diffuser plate from a horizontally flat position to a substantially vertical position.

* * * * *